US011713433B2

(12) United States Patent
Kubiak

(10) Patent No.: US 11,713,433 B2
(45) Date of Patent: Aug. 1, 2023

(54) SOLID LUBRICANT BAR

(71) Applicant: John Chester Kubiak, Gainesville, GA (US)

(72) Inventor: John Chester Kubiak, Gainesville, GA (US)

( * ) Notice: Subject to any disclaimer, the term of this patent is extended or adjusted under 35 U.S.C. 154(b) by 0 days.

(21) Appl. No.: 17/408,118

(22) Filed: Aug. 20, 2021

(65) Prior Publication Data

US 2022/0056366 A1 Feb. 24, 2022

Related U.S. Application Data

(60) Provisional application No. 63/069,486, filed on Aug. 24, 2020.

(51) Int. Cl.

| | |
|---|---|
| ***C10M 169/04*** | (2006.01) |
| ***C10M 105/40*** | (2006.01) |
| ***C10M 103/02*** | (2006.01) |
| ***C10M 103/04*** | (2006.01) |
| ***C10M 111/02*** | (2006.01) |
| ***C10M 125/10*** | (2006.01) |
| ***C10M 125/26*** | (2006.01) |
| *C10N 50/08* | (2006.01) |

(52) U.S. Cl.

CPC ..... *C10M 169/04* (2013.01); *C10M 103/02* (2013.01); *C10M 103/04* (2013.01); *C10M 105/40* (2013.01); *C10M 111/02* (2013.01); *C10M 125/10* (2013.01); *C10M 125/26* (2013.01); *C10M 2201/0413* (2013.01); *C10M 2201/053* (2013.01); *C10M 2201/062* (2013.01); *C10M 2201/087* (2013.01); *C10M 2207/402* (2013.01); *C10N 2050/08* (2013.01)

(58) Field of Classification Search

CPC ..... C10M 169/04; C10M 103/02; C10M 103/04; C10M 105/40; C10M 111/02; C10M 125/10; C10M 125/26; C10M 2201/0413; C10M 2201/053; C10M 2201/062; C10M 2201/087; C10M 2207/402; C10M 2201/084; C10M 2201/041; C10M 2201/05; C10M 2201/065; C10M 2201/066; C10M 2201/081; C10N 2050/08; C10N 2010/16; C10N 2010/02; C10N 2010/04; C10N 2010/06; C10N 2010/08; C10N 2010/12; C10N 2010/14; C10N 2020/011; C10N 2020/06; C10N 2040/02

See application file for complete search history.

(56) References Cited

U.S. PATENT DOCUMENTS

| | | | |
|---|---|---|---|
| 7,030,065 | B2 | 4/2006 | Lockett, Sr. |
| 7,723,275 | B2 | 5/2010 | Patel et al. |
| 8,420,581 | B2 | 4/2013 | Goto et al. |
| 8,758,876 | B2 | 6/2014 | Carcagno et al. |
| 2005/0197259 | A1 | 9/2005 | Levy |
| 2008/0011776 | A1* | 1/2008 | Patel ..... C10M 169/00 508/591 |

OTHER PUBLICATIONS

International Search Report/Written Opinion released by the U.S. Patent and Trademark Office as International Search Authority dated Nov. 24, 2021 for corresponding International Patent Application No. PCT/US2021/047242; 9 pages.

* cited by examiner

*Primary Examiner* — Taiwo Oladapo

(74) *Attorney, Agent, or Firm* — Smith, Gambrell & Russell LLP

(57) ABSTRACT

A solid lubricant bar comprising hydrogenated castor oil or wax, expandable flake graphite, and copper. ATH, MDH, and zinc borate can also be added to the formulation to enhance fire retardancy and suppression.

12 Claims, No Drawings

SOLID LUBRICANT BAR

CLAIM OF PRIORITY

This application claims priority from U.S. Provisional Patent Application Ser. No. 63/069,486, filed on Aug. 24, 2020, which is incorporated herein in its entirety.

FIELD OF THE INVENTION

This invention relates to a solid lubricant bar for lubricating the interface between the support pads of the cylindrical kiln shell and the inside diameter of the kiln tires of a hot rotary kiln.

BACKGROUND OF THE INVENTION

Hot rotary cylindrical kilns are used in cement plants, paper mills, and mineral processing plants to dry materials and to help chemical reactions take place. A hot rotary cylindrical kiln comprises a cylindrical kiln shell supported at axial intervals by kiln tires. The kiln tires in turn are supported on rotating trunnions. Filler bars or support pads are attached around the circumference of the cylindrical shell and frictionally engage the inside bore of the kiln tires. The resulting interface between the support pads of the kiln shell and the inside bore of the kiln tires requires lubrication. Because of the heat generated by the kiln, the lubrication may be provided in the form of solid lubricant bars placed between the support pads and the inside diameter of the kiln tires. The temperature of the kiln shell causes the solid lubricant bars to melt and distribute lubricant along the interface between the support pads and the inside bore the kiln tires.

The assignee of the present invention manufactures and sells a solid lubricant bar that comprises by weight: soy wax (60%), regular graphite (35%), and copper (5%). In addition, the prior art includes Lockett U.S. Pat. No. 6,767,870 (the "870 patent") and Lockett U.S. Pat. No. 7,030,065 (the "065 patent"). Both the 870 patent and the 065 patent use an organophosphate (including triphenyl phosphate (TPP)) in their formulations. Such organophosphates are toxic and hazardous to the health of personnel, who must handle the solid lubricant bars. The TPP is added to the lubricant bar formulation of the 870 patent and the 065 patent in order to raise the auto-ignition temperature of the lubricant bars. Particularly, the formulations disclosed in the 870 patent and the 065 patent claim to have auto-ignition temperatures above 1000° Fahrenheit (F) (538° C.).

SUMMARY OF THE INVENTION

The present invention is a solid lubricant bar useful for lubricating the interface between the support pads of the kiln shell and the inner diameter of the kiln tires. The formulation of the solid lubricant bar of the present invention is free of toxic materials and has an auto-ignition temperature above 1000° F. (538° C.). The solid lubricant bar of the present invention is generally formed of hydrogenated castor oil or castor wax, expandable flake graphite, and copper. Alumina trihydrate (ATH) and magnesium hydroxide (MDH) can also be added to the formulation to enhance fire retardancy and suppression.

Further objects, features and advantages will become apparent upon consideration of the following detailed description of the invention.

DETAILED DESCRIPTION OF THE PREFERRED EMBODIMENT

A solid lubricant bar in accordance with the present invention comprises the following formulation (1) by weight:

Hydrogenated castor oil or wax 60%
Expandable flake graphite 35%
Copper powder 5%

In the above formula, the hydrogenated castor oil or wax can range from 35%-65% by weight, the expandable flake graphite can range from 30%-60% by weight, and the copper can range from 5%-15% by weight.

The specification for the hydrogenated castor wax MP 70 flakes is set forth in Table 1 below.

TABLE 1

Castor Wax MP 70 Flakes

| PARAMETERS | SPECIFICATION | TEST METHOD |
|---|---|---|
| Acid Value | 2.5 maximum | AOCS Da 14-48 |
| Saponification Value | 176-186 | AOCS Cd 3-25 |
| Hydroxyl Value | 154-175 | AOCS Cd 13-60 |
| Melting Point, ° C. | 68-72 | AOCS Cc 3-25 |
| Iodine Value | 40-50 | AOCS Tg 1a-64 |

The hydrogenated castor wax MP 70 flakes can be procured from Acme Hardesty Oleochemicals of Bluebell, Pa. The designation MP 70 pertains to the melting point, 70° C. Other versions, including MP 60 and MP 80, are available with melting points of 60° C. and 80° C. respectively.

Grade 3626 of expandable flake graphite is useful in preparing the formulation (1) above. The properties of the expandable flake graphite is set forth in Tables 2, 3, and 4 below.

TABLE 2

General Product Description Expandable Flake

| Characteristic | Minimum | Maximum |
|---|---|---|
| % Moisture | 0 | 1 |
| % Sulfur | 0 | 4 |
| % ExpCarb | 80 | 100 |
| % +20 Total (850 Micron) | 0 | 0.1 |
| % +80 Total (180 Micron) | 0 | 30 |
| % −200 Total (75 Micron) | 0 | 25 |
| Expansion Ratio X:1 | 130 | 180 |
| pH | 5 | 10 |

TABLE 3

Typical Analysis (U.S. Standard Test Sieves)

| | |
|---|---|
| % Moisture | 0.69 |
| % Sulfur | 3.08 |
| % ExpCarb | 91.03 |
| % +20 Total (850 Micron) | 0 |
| % +40 Mesh (425 Micron) | 0.01 |
| % +60 Mesh (250 Micron) | 0.4 |
| % +70 Mesh (212 Micron) | 2.45 |
| % +80 Mesh (180 Micron) | 17.89 |
| % +80 Total (180 Micron) | 20.61 |
| % +100 Mesh (150 Micron) | 30.57 |
| % +200 Mesh (75 Micron) | 40.3 |

TABLE 3-continued

| Typical Analysis (U.S. Standard Test Sieves) | |
|---|---|
| % −200 Total (75 Micron) | 8.52 |
| % +325 Mesh (44 Micron) | 5.8 |
| % −325 Mesh (44 Micron) 2 | .72 |
| Expansion Ratio X:1 | 150 |
| pH | 6.52 |

TABLE 4

| Test Methods | |
|---|---|
| % Expanded Carbon | E4-6 |
| % Moisture | E4-2 |
| % Sulfur | E4-9 |
| Expansion Ratio | E4-4 |
| pH | E4-5B |
| Sieve Analysis | E-2 |

The grade 3626 expandable flake graphite can be procured from Asbury Graphite of North Carolina Inc., 191 Magna Blvd., Lumberton, N.C. 28360.

Other grades of expandable flake graphite, shown in Table 5 below are also suitable for the formulation (1) above.

TABLE 5

Expandable Flake Graphite Grades

| Grade | Nominal Size μm | Carbon (%) | Moisture (%) | Sulfur (%) | Expansion Ratio (cc/g) | pH Range |
|---|---|---|---|---|---|---|
| 3772 | >300 | ≥98 | 0.9 | 3.1 | 300:1 | 5-10 |
| 1721 | >300 | ≥98 | 0.9 | 3.5 | 300:1 | 1-6 |
| 3721 | >300 | ≥95 | 0.9 | 3.5 | 290:1 | 5-10 |
| 1722 | >300 | ≥95 | 0.9 | 3.5 | 290:1 | 1-6 |
| 3335 | >300 | ≥85 | 0.9 | 3.2 | 270:1 | 5-10 |
| 3577 | >300 | ≥85 | 0.9 | 3.4 | 270:1 | 1-6 |
| 3570 | >180 | ≥80 | 0.8 | 3.1 | 230:1 | 5-10 |
| 1395 | >180 | ≥80 | 0.8 | 3.5 | 230:1 | 1-6 |
| 3558 | >180 | ≥99 | 0.8 | 3.1 | 210:1 | 5-10 |
| 3626 | >75 | ≥80 | 0.6 | 3.0 | 160:1 | 5-10 |
| 3494 | >75 | ≥80 | 0.9 | 2.9 | 90:1 | 1-6 |
| 3538 | <75 | ≥80 | 1.4 | 2.6 | 60:1 | 5-10 |

The specification for the copper powder of formula (1) is shown in Table 6 below.

TABLE 6

BR-83 UP Copper

| | |
|---|---|
| Color shade: | Copper |
| Pigment type: | Cornflake pigment |
| Leafing/non-leafing: | Non-leafing |
| NVM: | 100 |
| Shelf life: | 12 months |
| Fatty Acids: | 1.1% max |
| Typical particle size | |
| D10 in Helos [μm]: | 4 |
| D50 in Helos [μm]: | 8 |
| D90 in Helos [μm]: | 17 |

The copper powder can be procured from Eckart America Corporation, 4101 Camp Ground Road, Louisville Ky. 4021.

The above formulation (1) may also include other solid lubricants instead of copper including sulphides, selenides, and tellurides (chalcogenides) of molybdenum, tungsten, niobium, tantalum, titanium (eg. $WS_2$, $WS_2$, $MoSe_2$, $TaSe_2$, $TiTe_2$), monochalcenides (GaS, GaSe, SnSe), chlorides of cadmium, cobalt, lead, cerium, zirconium (eg. $CdCl_2$, $CoCl_2$, $PbCl_2$, $CeF_3$, $PbI_2$), borates (eg. $Na_2B_4O_7$), sulfates ($Ag_2SO_4$), or oxides ($B_2O_3$, $MoO_2$, ZnO, $Re_2O_7$, $TiO_2$, CuO—$MoO_2$, NiO—$Mo_2$, PbO—$B_2O_3$, CuO—$Re_2O_7$).

When tested, the formulation (1) above achieved an auto-ignition temperature above 1000° F. (538° C.) and approached 1200° F. (538° C.). Because the formulation (1) comprises individual ingredients, each with proven lubrication properties, the combination of formula (1) provides a synergistic solid lubrication bar that is eco-friendly and avoids the use of toxic flame retardant compounds. Consequently, the formulation (1) provides superior lubrication performance when used with high temperature kilns.

In some cases, a blend of zinc borate $Zn[B_3O_4(OH)_3]$, magnesium hydroxide (MDH), and alumina trihydrate (ATH) can assist in providing additional flame retardancy and fire suppression because of the different temperatures at which zinc borate, ATH, and MDH decompose to generate water molecules. The following formula (2) by weight is useful in implementing the solid lubrication bar of the present invention.

Hydrogenated castor oil or wax 50%
Expandable flake graphite 40%
Copper powder 5%
ATH 1%
MDH 2%
Zinc borate 2%

In the above formula (2), the hydrogenated castor oil or wax can range from 40%-60% by weight, the expandable flake graphite can range from 30%-50% by weight, the copper can range from 3%-6% by weight, the ATH can range from 2%-5% by weight, and MDH can range from 2%-3% by weight and zinc borate can range from 2%-3% by weight. Formula (2) above has an auto-ignition temperature above 1000° F. and provides superior lubrication performance when used with high temperature kilns.

A formula (3) below is also useful in implementing the solid lubrication bar of the present invention.

Hydrogenated Castor oil or wax 50%
Expandable flake graphite 40%
Copper Powder 5%
ATH 1%
MDH 1%
Zinc borate 3%

In the above formula (3), the hydrogenated castor oil or wax can range from 40%-60% by weight, the expandable flake graphite can range from 30%-50% by weight, the copper can range from 3%-6% by weight, the zinc borate can range from 1%-3%, by weight, and MDH can range from 1%-2% by weight and ATH can range from 1%-2% by weight. Formula (3) above has an auto-ignition temperature above 1000° F. and provides superior lubrication performance when used with high temperature kilns.

While this invention has been described with reference to preferred embodiments thereof, it is to be understood that variations and modifications can be affected within the spirit and scope of the invention as described herein and as described in the appended claims.

I claim:

1. A lubricant bar comprising by weight:

a. hydrogenated castor oil ranging from 35% to 65%;

b. expandable flake graphite ranging from 30% to 60%; and c. copper ranging from 5% to 15%.

2. The lubricant bar of claim 1, wherein the hydrogenated castor oil or wax is 60% by weight, the expandable flake graphite is 35% by weight, and the copper is 5% by weight.

3. The lubricant bar of claim 1, wherein the hydrogenated castor oil has a melting temperature between 60° C. and 80° C.

4. A lubricant bar comprising by weight:

a. hydrogenated castor oil ranging from 40% to 60%;

b. expandable flake graphite ranging from 30% to 50%;

c. copper ranging from 3% to 5%;

d. Alumina trihydrate ranging from 1% to 5%;

e. magnesium hydroxide ranging from 1% to 5%; and f. zinc borate ranging from 2% to 5%.

5. The lubricant bar of claim 4, wherein the hydrogenated castor oil or wax is 50% by weight, the expandable flake graphite is 40% by weight, the copper is 5% by weight, the Alumina trihydrate is 2% by weight, and magnesium hydroxide is 3% by weight, and zinc borate is 3% by weight.

6. The lubricant bar of claim 4, wherein the hydrogenated castor oil has a melting temperature between 60° C. and 80° C.

7. A method for lubricating an interface between a support pad of a kiln shell and an inner diameter of a kiln tire, the method comprising the step of applying an effective amount of lubricant in the form of a lubricant bar comprising by weight:

a. hydrogenated castor oil ranging from 35% to 65%;

b. expandable flake graphite ranging from 30% to 60%; and c. copper ranging from 5% to 15%.

8. The method of claim 7, wherein the hydrogenated castor oil or wax 60% by weight, the expandable flake graphite is 35% by weight, and the copper is 5% by weight.

9. The method of claim 7, wherein the hydrogenated castor oil has a melting temperature between 60° C. and 80° C.

10. A method for lubricating an interface between a support pad of a kiln shell and an inner diameter of a kiln tire, the method comprising the step of applying an effective amount of lubricant in the form of a lubricant bar comprising by weight:

a. hydrogenated castor oil ranging from 40%-60%;

b. expandable flake graphite ranging from 30%-50%;

c. copper ranging from 3%-5%;

d. Alumina trihydrate ranging from 1%-5%;

e. magnesium hydroxide ranging from 1%-5%; and f. zinc borate ranging from 2%-5%.

11. The method of claim 10, wherein the hydrogenated castor oil or wax is 50% by weight, the expandable flake graphite is 40% by weight, the copper is 5% by weight, the Alumina trihydrate is 2% by weight, and magnesium hydroxide is 3% by weight, and zinc borate is 3% by weight.

12. The method of claim 10, wherein the hydrogenated castor oil has a melting temperature between 60° C. and 80° C.

* * * * *